US011181242B2

(12) United States Patent
Stange

(10) Patent No.: US 11,181,242 B2
(45) Date of Patent: Nov. 23, 2021

(54) TRUNK WRAP LIGHTING DEVICE

(71) Applicant: Kurt Stange, Miami Beach, FL (US)

(72) Inventor: Kurt Stange, Miami Beach, FL (US)

(73) Assignee: South Florida Lighting Team, LLC, Miami Beach, FL (US)

( * ) Notice: Subject to any disclaimer, the term of this patent is extended or adjusted under 35 U.S.C. 154(b) by 0 days.

(21) Appl. No.: 16/615,663

(22) PCT Filed: May 22, 2018

(86) PCT No.: PCT/US2018/033949

§ 371 (c)(1),
(2) Date: Nov. 21, 2019

(87) PCT Pub. No.: WO2018/217797

PCT Pub. Date: Nov. 29, 2018

(65) Prior Publication Data

US 2020/0208794 A1 Jul. 2, 2020

Related U.S. Application Data

(60) Provisional application No. 62/510,089, filed on May 23, 2017.

(51) Int. Cl.

| | |
|---|---|
| ***F21S 4/15*** | (2016.01) |
| ***F21V 21/08*** | (2006.01) |
| ***F21V 23/06*** | (2006.01) |
| *F21Y 115/10* | (2016.01) |

(52) U.S. Cl.

CPC ..... *F21S 4/15* (2016.01); *F21V 21/0816* (2013.01); *F21V 23/06* (2013.01); *F21Y 2115/10* (2016.08)

(58) Field of Classification Search

CPC ..... F21S 4/15; F21S 4/22; F21S 4/24; F21S 4/26; F21V 21/0816; F21V 23/06; F21Y 2115/10

See application file for complete search history.

(56) References Cited

U.S. PATENT DOCUMENTS

| | | | | | |
|---|---|---|---|---|---|
| 3,096,943 | A * | 7/1963 | Forrer | H01R 33/00 | 362/249.15 |
| 4,870,547 | A * | 9/1989 | Crucefix | F21S 4/10 | 362/123 |
| 5,057,976 | A * | 10/1991 | DuMong | F21S 4/10 | 362/123 |
| 5,213,519 | A * | 5/1993 | Dorfman | H01R 25/003 | 439/505 |
| 5,424,925 | A * | 6/1995 | Jenke | F21S 4/10 | 362/103 |
| 5,601,361 | A * | 2/1997 | Lawrence | F21S 4/10 | 362/123 |
| 5,632,550 | A * | 5/1997 | Yeh | H05B 45/50 | 362/123 |

(Continued)

*Primary Examiner* — Zheng Song

(74) *Attorney, Agent, or Firm* — Johnson & Martin, P.A.; James David Johnson

(57) ABSTRACT

A lighting device is described, which can be wrapped or attached securely around a trunk or branch of a tree or around a column, beam, pole, an arch, or other object around which the lighting device can be attached. The device includes a light apparatus having a string of lights arranged into a mesh of lights or a preformed mesh of lights, a first cord connected across a top end of the light apparatus and having a hook on each end, and at least a second cord connected across a bottom end of the light apparatus and also having a hook on each end.

9 Claims, 5 Drawing Sheets

(56) References Cited

U.S. PATENT DOCUMENTS 5,893,634 A * 4/1999 Wang ..... F21S 4/15 362/249.01
6,135,616 A * 10/2000 Rahman ..... F21V 23/0407 362/249.12
6,149,284 A * 11/2000 Wang ..... F21S 4/10 362/123
6,152,576 A * 11/2000 Mount ..... F21V 21/00 362/249.14
6,203,171 B1 * 3/2001 Sherman, Jr. ..... A47G 33/06 362/121
6,213,624 B1 * 4/2001 Lin ..... F21S 4/10 362/123
6,367,951 B1 * 4/2002 Kumada ..... F21S 4/15 362/249.15
6,474,841 B1 * 11/2002 Rahman ..... F21S 4/00 362/249.14
6,527,413 B1 * 3/2003 McIngvale ..... F21V 21/10 362/123
6,575,595 B1 * 6/2003 Wu ..... F21S 4/15 362/123
6,634,766 B1 * 10/2003 Gordon ..... F21S 4/10 362/239
7,045,965 B2 * 5/2006 Li ..... H05B 45/00 315/185 S
7,063,442 B2 * 6/2006 Sugar ..... F21S 4/10 362/219
7,249,866 B1 * 7/2007 Tai ..... F21V 21/008 362/147
9,261,249 B2 * 2/2016 Cheng ..... F21S 4/10
9,746,163 B1 * 8/2017 Acosta, Sr. ..... F21S 4/10
9,845,925 B2 * 12/2017 Chen ..... F21V 23/06
2007/0041189 A1 * 2/2007 Mchinnis ..... F21S 4/10 362/249.16
2007/0081363 A1 * 4/2007 Heese ..... F21S 8/068 362/654
2010/0286910 A1 * 11/2010 Hudson ..... F21S 4/10 701/469
2015/0078000 A1 * 3/2015 Chen ..... F21V 23/001 362/249.16
2019/0113188 A1 * 4/2019 Miller ..... F21V 23/06
2019/0285232 A1 * 9/2019 Chen ..... F21V 23/06
2020/0200343 A1 * 6/2020 Chen ..... H05B 47/155

* cited by examiner

TRUNK WRAP LIGHTING DEVICE

FIELD OF THE INVENTION

The invention relates to a lighting device. More particularly, the invention relates to a lighting device that can be wrapped or attached securely around a trunk or branch of a tree or around a column, beam, pole, or other generally linear object.

BACKGROUND

The decoration or ornamentation of tree trunks with Christmas lights and other lighting devices has been accomplished using strings of lights that are wrapped around a tree trunk and connected by nails, tacks, or other securing mechanisms. Securing the lights around trees has been difficult, time consuming, and inefficient.

A need exists for a quick and efficient device and method for decorating a trunk of a tree or other generally linear object with Christmas lights or other decorative lights.

SUMMARY

The invention relates to a wrapping light device that includes a decorative light apparatus, a first cord, and at least a second cord. One or both of the first cord and the second cord can be elastic. The decorative wrapping light device (also referred to elsewhere herein as a lighting device) can be secured around a trunk or branch of a tree, a column, a post, a beam, a pole, or any other generally linear object. The decorative light apparatus includes a string of lights arranged into a mesh of lights or a preformed mesh of lights. The decorative light apparatus can include a plurality of lights, a first end having a male electrical plug for connecting to a power source, and a second end having a female electrical socket. The decorative light apparatus also includes a top end and a bottom end and two sides. The first elastic cord is connected across the top end of the decorative light apparatus. The first elastic cord includes a first end having a first hook and a second end having a second hook that is connectable to the first hook to secure the top end of the decorative light apparatus around a tree trunk or column. The at least a second elastic cord is connected across the bottom end of the decorative light apparatus. The second elastic cord includes a first end having a first hook and a second end having a second hook that is connectable to the first hook to secure the bottom end of the decorative light apparatus around the tree trunk or column.

The invention can feature two or more decorative light apparatuses connected together electrically using their respective male electrical plugs and female electric sockets so that a portion of the tree trunk (or branch) or column can be decorated with lights.

The lighting device and methods described herein provide an advantage over conventional lighting devices and methods in that a tree trunk or other generally linear object may be decorated quickly in an aesthetically pleasing manner partially or about entirely using one or more lighting devices each of which includes a mesh of lights that can be electrically connected to one another and to a power source.

Accordingly, the invention relates to a wrapping light device that includes a light apparatus, a first cord, and at least a second cord. The light apparatus includes at least two strings of light-emitting elements and a first end having a male electrical plug for connecting to a power source. The light apparatus includes a top end and a bottom end. The first cord connects across the top end of the light apparatus. The first cord includes a first end having a first hook and a second end having an engagement apparatus that is connectable to the first hook to secure the top end of the light apparatus around an object. The at least second cord connects across the bottom end of the light apparatus. The second cord includes a first end having a first hook and an engagement apparatus that is connectable to the first hook to secure the bottom end of the light apparatus around the object.

In another aspect, the invention features the object being or including a generally linear object.

In another aspect, the invention features the object being or including a tree trunk, a tree branch, a shrub or bush, a column, a beam, a pole, an arch, or any other object around which the device is attachable.

In another aspect, the invention features the device further including a second end having a female electrical socket.

In another aspect, the invention features two or more light apparatuses being connectable together electrically using their respective male electrical plugs and female electric sockets so that the two or more lighting apparatuses are attached around at least a portion of the object.

In another aspect, the invention features the light-emitting elements being or including light-emitting diodes (LEDs).

In another aspect, the invention features the engagement apparatus that is connectable to the first hook of the first cord being or including a loop of the first cord.

In another aspect, the invention features the engagement apparatus that is connectable to the first hook of the first cord being or including a second hook of the first cord.

In another aspect, the invention features the first hook and the second hook being corrosion-resistant.

In another aspect, the invention features the engagement apparatus that is connectable to the first hook of the second cord being or including a loop of the second cord.

In another aspect, the invention features the engagement apparatus that is connectable to the first hook of the second cord being or including a second hook of the second cord.

In another aspect, the invention features the first hook and the second hook being corrosion-resistant.

The invention also features a wrapping light device that includes a light apparatus, a first cord, and at least a second cord. The light apparatus includes at least two strings of light-emitting elements, a first end having a male electrical plug for connecting to a power source, and a second end having a female electrical socket. The light apparatus includes a top end and a bottom end. The first cord connects across the top end of the light apparatus. The first cord includes a first end having a first hook and a second end having an engagement apparatus that is connectable to the first hook to secure the top end of the light apparatus around an object. The at least a second cord connects across the bottom end of the light apparatus. The second cord includes a first end having a first hook and an engagement apparatus that is connectable to the first hook to secure the bottom end of the light apparatus around the object.

In another aspect, the invention features the object being or including a generally linear object.

In another aspect, the invention features the object being or including a tree trunk, a tree branch, a shrub or bush, a column, a beam, a pole, an arch, or any other object around which the device is attachable.

In another aspect, the invention features two or more light apparatuses being connectable together electrically using their respective male electrical plugs and female electric sockets so that the two or more lighting apparatuses are attached around at least a portion of the object.

In another aspect, the invention features the plurality of light-emitting elements being or including light-emitting diodes (LEDs).

In another aspect, the invention features the engagement apparatus that is connectable to the first hook of the first cord being or including a loop or a second hook of the first cord.

In another aspect, the invention features the engagement apparatus that is connectable to the first hook of the second cord being or including a loop or a second hook of the second cord.

The invention also relates to a mesh lighting source that includes a first set of at least two strings of light-emitting elements, a second set of at least two strings of light-emitting elements. The first set of at least two strings of light-emitting elements are oriented in a first direction relative to a male electrical plug that is connectable to a power source, and the second set of at least two strings of light-emitting elements are oriented in a second direction relative to the first set of at least two strings of light-emitting elements. The foregoing first and second sets of light strings form a mesh having a top end and a bottom end. The at least one cord includes a first engagement apparatus and a second engagement apparatus. The first and second engagement apparatuses are connectable to secure the mesh to an object.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
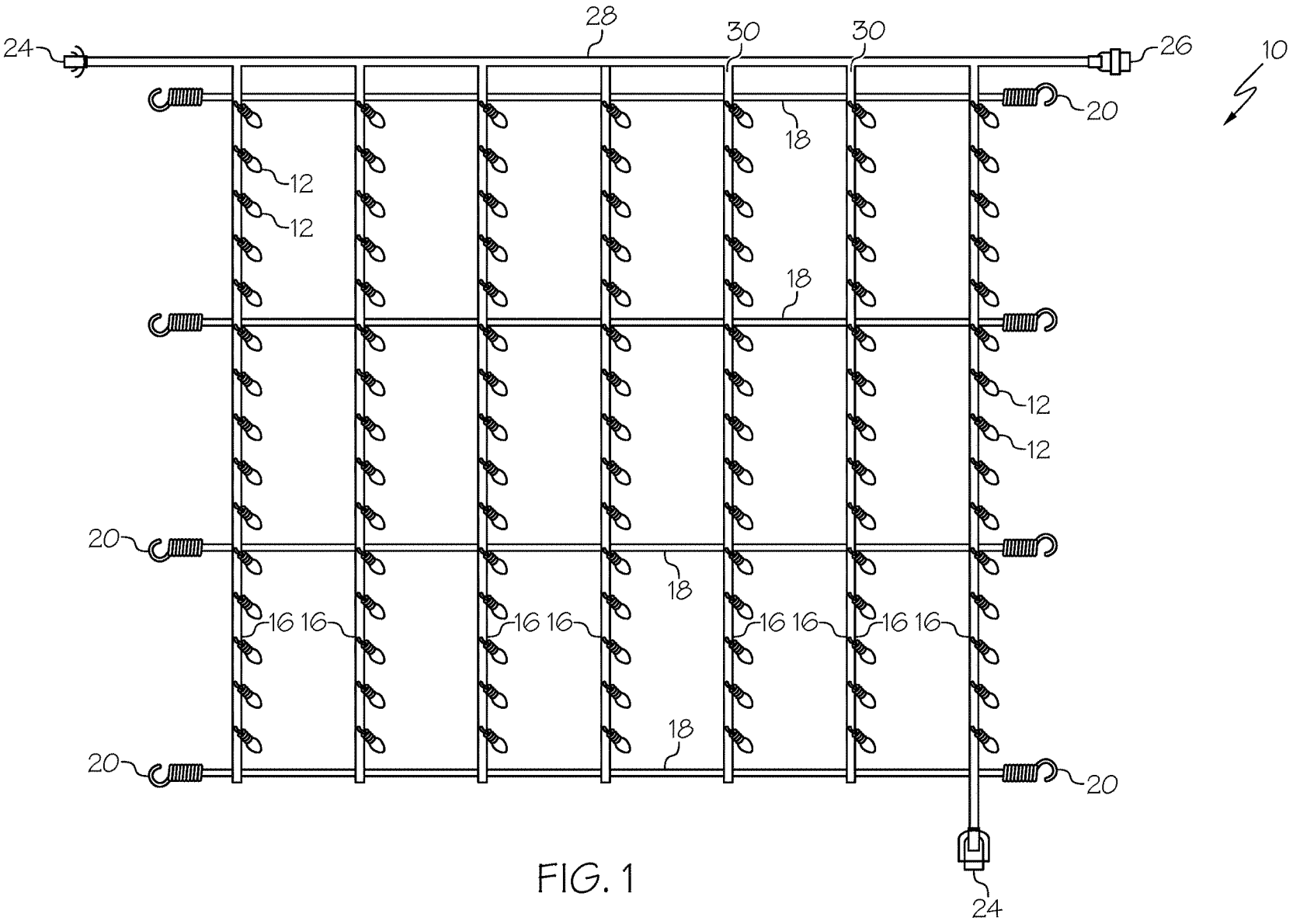
FIG. 1 is a top plan view of one embodiment of a lighting device.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

Figure 2:
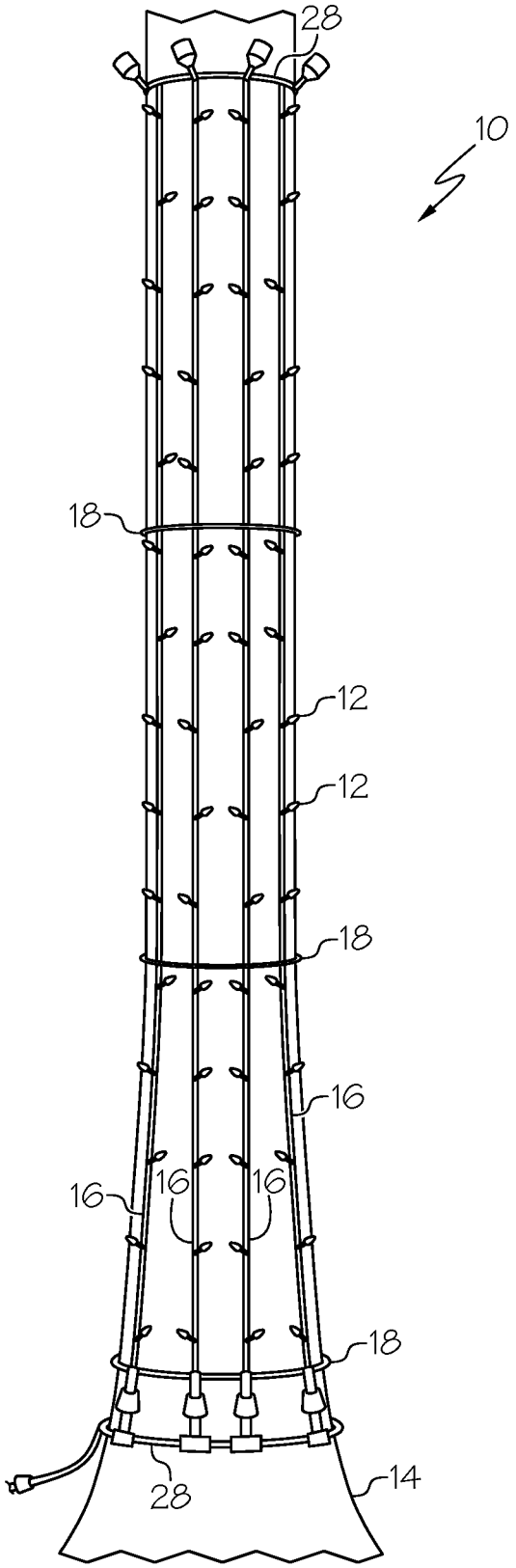
FIG. 2 is a side elevation view of one embodiment of the lighting device secured around a trunk of a tree.
Figure 3:
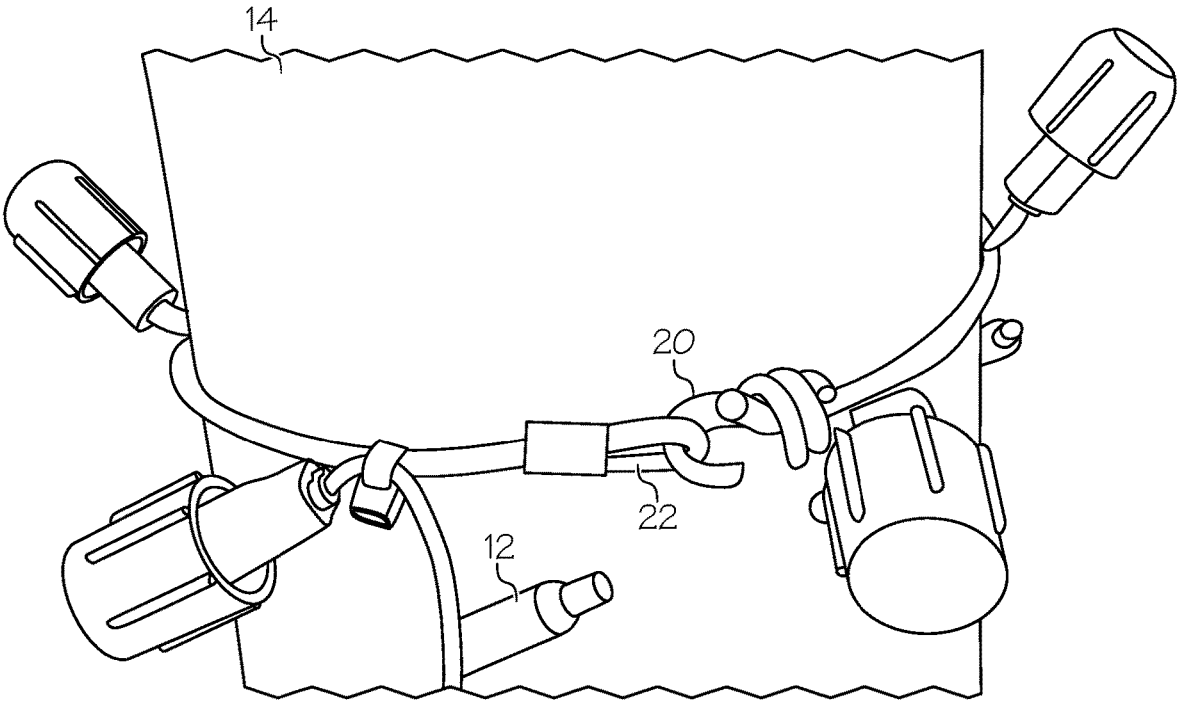
FIG. 3 is a side elevation view of a first end of a first securing cord of a top end of the lighting device connected to a second end of the first securing cord of the lighting device.
Figure 4:
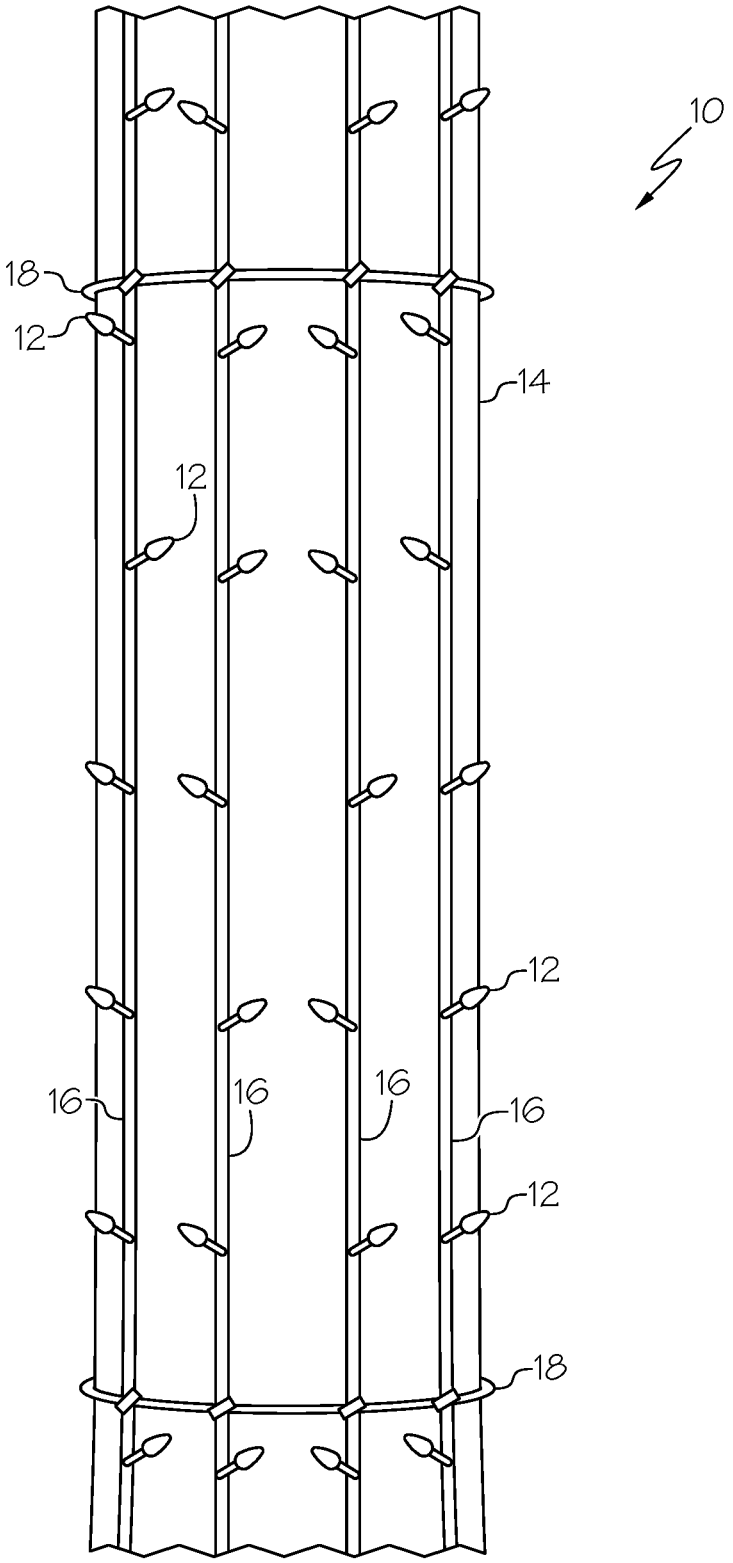
FIG. 4 is a photograph of the lighting device secured around a trunk of a tree.
Figure 5:
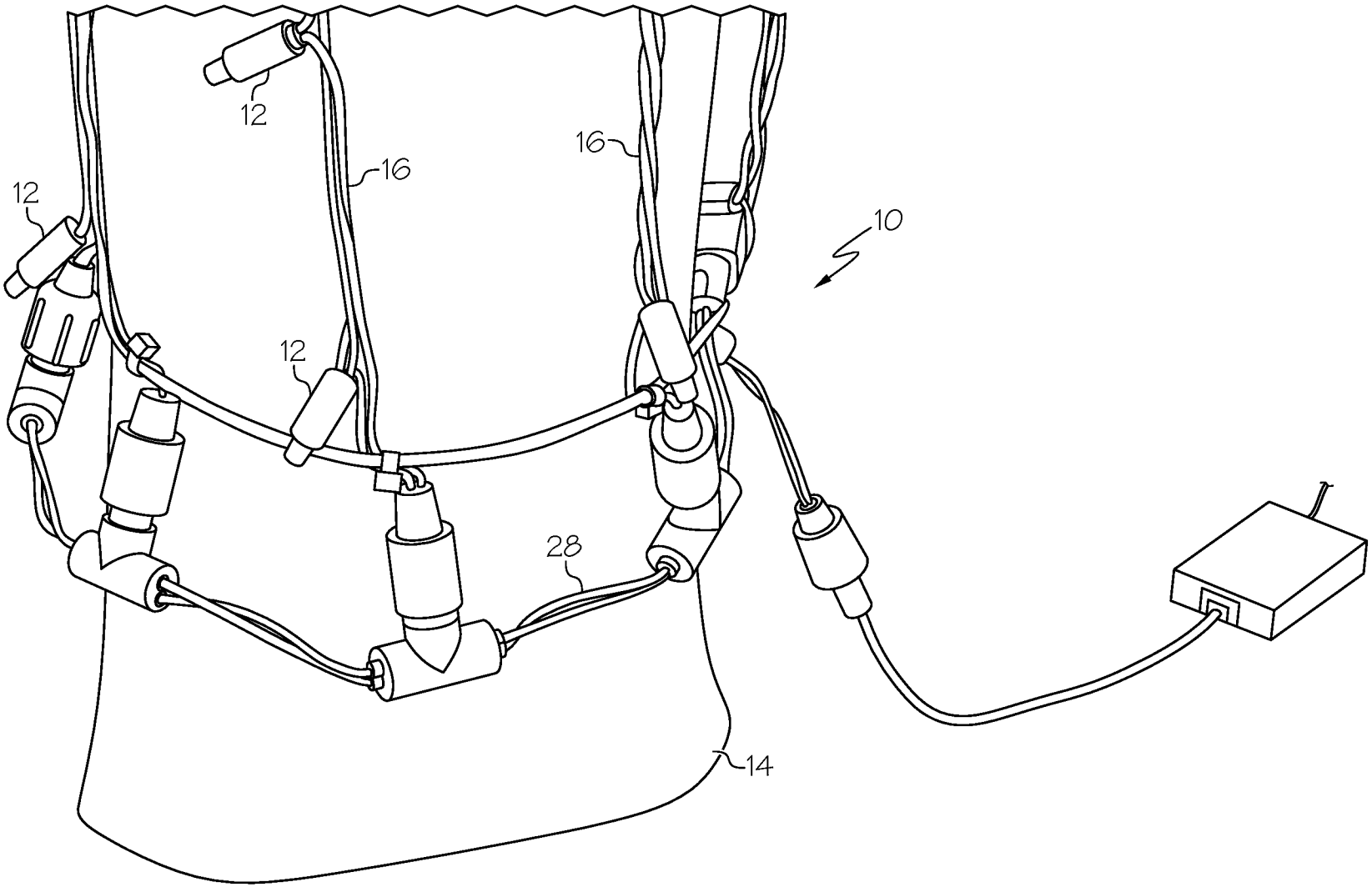
FIG. 5 is a side elevation view of an at least second securing cord of a bottom end of the lighting device secured around the trunk of the tree with the lighting device being electrically connected to a power source.

The invention provides a device 10 for wrapping a plurality of lights 12 around a trunk 14 or branch 14 of a tree or a column 14. The device 10 can be a decorative lighting device and the plurality of lights can be decorative lights, e.g., for use as holiday decorations. As shown in FIGS. 1-5, the device 10 includes a string of lights 16 formed into a mesh. Lights preformed into a mesh may also be used with this device, although for convenience herein, the device 10 is described with reference to a string of lights 16. The lights 12 may be arranged in rows, other geometrical arrangements, or in random patterns on the mesh. The string of lights 16 can be LED lights 12, incandescent lights 12, or other types of lights 12 that are of the type normally used for Christmas and holiday light strings. The device can be installed around the tree trunk or column as a lighted decoration at Christmas or another holiday or for decorative purposes unrelated to any holiday. The mesh can be created in various sizes for fitting tree trunks or other linear or non-linear objects of various sizes. In another embodiment, multiple lighting devices 10 may be connected together electrically before or after securing them around a tree trunk 14 or other linear or non-linear object 14 that is too large to be covered by only one such lighting device. In some embodiments, the device 10 can be attached around an object 14 that is not generally linear, e.g., around an arch. The object 14 around which the device 10 is attached can be generally cylindrical or another shape in cross-section, e.g., square, rectangular, triangular, polygonal, quadrilateral, oval, elliptical, or irregular.

The mesh is attached at top and bottom ends to a cord 18, e.g., a bungee cord. In exemplary embodiments, the cord 18 or cords of the device 10 can be elastic. For purposes of convenience, the cords herein are referred to as elastic cords. In some embodiments, the cords may be cords that are not elastic. The elastic cord 18 includes a hook 20 or other attachment device on each end that may be used to connect the two ends of the elastic cord together to secure the mesh of lights around the tree trunk or column. Installation around the tree trunk or column is accomplished by stretching the elastic cord at the top end of the device around the tree trunk or column until its two hooks can be hooked to one another. Similarly, the elastic cord 18 at the bottom end of the device 10 is stretched around the tree trunk 14 or column until its two hooks 20 also can be hooked to one another. The device 10 may include additional elastic cords 18 that are attached across a horizontal section of the mesh of lights, which may also be connected together using the hooks 20 at their ends to secure the device around the tree trunk or column. In some embodiments, one end of an elastic cord 18 of the device 10 includes a hook 20 and the other end of the elastic cord also includes a hook 20 for connecting to the first hook. In other embodiments, one end of the elastic cord 18 of the device 10 includes a hook 20 and the other end of the elastic cord includes a loop 22 to which the hook can be connected. In embodiments that include hooks, the hooks may be corrosion-resistant. For example, one or more of the hooks could be metal having a plastic coating.

A first end of the string of lights 16 forming the mesh includes a male electrical plug 26 and a second end of the string of lights includes a female electrical socket 24 so that a series of the devices can be connected together with the last device in the series (typically the device installed at the bottom of the tree trunk or column) being connected to a power source.

In one exemplary embodiment of the device 10, an electrical cord 28 having a first end with a male electric plug 26 and a second end includes two or more strings 16 of light-emitting elements 12 electrically connected to the electric cord and hanging vertically beneath the electrical cord from their points of attachment 30. The electrical cord 28 is oriented in a generally horizontal orientation relative to the hanging strings of lights 16, which can be arranged in rows hanging vertically beneath the electrical cord. At or near the electrical cord 28, an elastic cord 18 can be connected between the rows of hanging strings 16 of light-emitting elements. In more exemplary embodiments, the device 10 can include two or more elastic cords 18 to allow for easy and secure attachment of the device around a generally linear object 14 such as, for example, a tree trunk, a tree branch, a bush or shrub, a pole, a column, a beam, or any other generally linear object.

In some embodiments, the device 10 includes only a single electrical cord 28 having at least a male electrical plug 26. The electrical cord 28 can include a female electrical socket 24 for receiving the male electrical plug 26 of another one of the devices 10 so two or more the devices 10 may be linked together electrically and spatially to decoratively wrap around a generally linear object 14 like a tree trunk. In other embodiments, the device 10 may include more than one electrical cord 28, each of which may include a male electrical plug 26, a female electrical socket 24, or both. In some embodiments, the electrical cords 28 are positioned in the same orientation, e.g., one at a top of the device 10 and another near the bottom in a horizontal orientation. In other embodiments, one electrical cord 28 can be positioned in a first orientation (e.g., horizontally) relative to the strings 16 of light-emitting elements 12 hanging from it while one or more other electrical cords 28 are positioned in a second orientation (e.g., vertically and parallel) relative to the strings of light-emitting elements.

The device 10 is useful for wrapping any generally linear object 14 with decorative lighting but is very well suited for wrapping tree trunks (e.g., a palm tree) with decorative or holiday lighting.

OTHER EMBODIMENTS

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A mesh lighting source comprising:

a first electrical cord comprising a male electrical plug and a female connector, wherein the first electrical cord forms a top or bottom end of a mesh;

a second electrical cord comprising a free end comprising a male electrical plug and a fixed end attached to the first electrical cord; wherein the second electrical cord is oriented perpendicularly in relation to its attachment to the first electrical cord;

at least two strings of light-emitting elements oriented in a different direction relative to an orientation of the first electrical cord wherein each of the at least two strings of light-emitting elements is electrically connected to the first electrical cord at a generally perpendicular point of attachment; and at least one securing cord comprising a first engagement apparatus and a second engagement apparatus; wherein the first and second engagement apparatuses are connectable to secure the mesh to an object; wherein the at least one securing cord is oriented parallel to the first electrical cord and extends perpendicularly next to the at least two strings of light-emitting elements;

wherein the mesh is formed by the perpendicular arrangement of the at least two strings of light-emitting elements relative to orientations of the first electrical cord and the at least one securing cord.

2. The mesh lighting source of claim 1, wherein the object comprises a generally linear object.

3. The mesh lighting source of claim 1, wherein the object comprises a tree trunk, a tree branch, a shrub or bush, a column, a beam, a pole, an arch, or any other object around which the mesh lighting source is attachable.

4. The mesh lighting source of claim 1, wherein two or more mesh lighting sources are connectable together electrically using their respective male electrical plugs and female electric sockets so that the two or more mesh lighting sources are attached around at least a portion of the object.

5. The mesh lighting source of claim 1, wherein the light-emitting elements comprise light-emitting diodes (LEDs).

6. The mesh lighting source of claim 1, wherein the first engagement apparatus comprises a first hook and the second engagement apparatus comprises a second hook that are connectable.

7. The mesh lighting source of claim 6, wherein the first hook and the second hook are corrosion-resistant.

8. The mesh lighting source of claim 1, wherein either the first engagement apparatus or the second engagement apparatus comprises a hook and wherein the other of the first engagement apparatus or the second engagement apparatus comprises a loop.

9. The mesh lighting source of claim 8, wherein the hook is corrosion-resistant.

* * * * *